US006810228B2

(12) United States Patent
Kiuchi et al.

(10) Patent No.: US 6,810,228 B2
(45) Date of Patent: Oct. 26, 2004

(54) IMAGE FORMING APPARATUS AND FIXING APPARATUS

(75) Inventors: Yutaka Kiuchi, Kanagawa (JP); Tohru Inoue, Kanagawa (JP); Yuichi Fukuda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/237,198

(22) Filed: Sep. 9, 2002

(65) Prior Publication Data

US 2003/0063930 A1 Apr. 3, 2003

(30) Foreign Application Priority Data

Sep. 18, 2001 (JP) ..... P.2001-283734

(51) Int. Cl.[7] ..... G03G 15/16; G03G 15/20

(52) U.S. Cl. ..... 399/307

(58) Field of Search ..... 399/302, 307, 399/308, 320, 322, 328, 399, 329; 347/156; 219/216

(56) References Cited

U.S. PATENT DOCUMENTS

| | | | | |
|---|---|---|---|---|
| 2,990,278 A | | 6/1961 | Carlson | |
| 4,242,566 A | * | 12/1980 | Scribner | 219/216 |
| 4,780,742 A | * | 10/1988 | Takahashi et al. | 399/320 |
| 5,293,537 A | * | 3/1994 | Carrish | 399/329 |
| 5,309,210 A | * | 5/1994 | Yamamoto et al. | 399/329 |
| 5,758,245 A | * | 5/1998 | Matsuura et al. | 399/329 |
| 5,835,830 A | * | 11/1998 | Fukuda et al. | 399/307 |
| 5,933,694 A | * | 8/1999 | Yamashita et al. | 399/322 |
| 6,141,524 A | * | 10/2000 | Berkes et al. | 399/307 |
| 6,400,913 B1 | * | 6/2002 | de Jong et al. | 399/307 X |
| 6,526,250 B1 | * | 2/2003 | Usui et al. | 399/307 |

FOREIGN PATENT DOCUMENTS

| | | |
|---|---|---|
| JP | 62-198876 | 9/1987 |
| JP | 1-245265 | 9/1989 |
| JP | 5-19642 | 1/1993 |
| JP | 5-107950 | 4/1993 |
| JP | 5-142959 | 6/1993 |
| JP | 5-249798 | 9/1993 |
| JP | 5-82940 B | 11/1993 |
| JP | 9-330006 | 12/1997 |
| JP | 2001-166610 | 6/2001 |

* cited by examiner

*Primary Examiner*—Sandra Brase
(74) *Attorney, Agent, or Firm*—Morgan, Lewis & Bockius, LLP

(57) ABSTRACT

An image forming apparatus includes an image carrying body, a heating unit, a pressure unit for applying pressure, a recording medium supporting member, and a depressing/close-contacting unit. The recording medium supporting member moves in the same direction as the image carrying body moves, from a pressure position where the pressure unit applies pressure to the recording medium and the image carrying body to an exfoliation position where the recording medium is exfoliated from the image carrying body while supporting the recording medium overlapped with the image carrying body. The depressing/close-contacting unit sandwiches and depresses the recording-medium supporting member and the image carrying body in a middle position between the pressure position and the exfoliation position to closely contact the recording medium with the image carrying body.

6 Claims, 5 Drawing Sheets

IMAGE FORMING APPARATUS AND FIXING APPARATUS

The present disclosure relates to the subject matter contained in Japanese Patent Application No.283734 filed on Sep. 10, 2002, which are incorporated herein by reference in its entirety.

BACKGROUND OF THE INVENTION

1. Field of the Invention

The present invention is related to an electrophotographic type image forming apparatus such as a copy machine, a printer, and a facsimile, and also related to a fixing apparatus thereof. Precisely speaking, the present invention is directed to a simultaneous image-transferring/fixing type image forming apparatus and a fixing apparatus thereof.

2. Description of the Related Art

Conventionally, image forming methods have been widely utilized by which electrostatic latent images are formed on photosensitive drums, these electrostatic latent images are developed by using dry type toners, and thereafter, the toner images are transferred onto recording media in electrostatic manners so as to be fixed thereon. In these conventional image forming methods, since concave/convex portions of a surface of paper corresponding to the recording media are present, this paper cannot be completely made in close contact with such a photosensitive drum, so that ununiform gaps may be produced. Therefore, there is such a problem that a transfer electric field is disturbed. Also, since Coulomb's repulsion may occur among the toners, there is another problem that images are disturbed.

To solve this problem, an image forming method of forming a color copy in the below-mentioned manner, and another image forming method has been proposed. That is, when a plurality of toner images having different colors are transferred onto an intermediate transfer member in a multiple manner, an electrostatic field is utilized, whereas when a multi-colored toner image transferred onto the intermediate transfer member is again transferred onto a recording medium, heat is utilized in order that the melted multi-colored toner image on the intermediate transfer member is transferred onto the recording medium and, at the same time, is fixed on this recording medium, and thus, such a color copy may be produced. On the other hand, in the latter image forming method, while a toner image formed on an endless belt-shaped photosensitive drum is heated so as to be melted, the melted toner image is transferred onto a recording medium so as to be fixed thereon.

In these image forming methods, since the toner images are transferred onto the recording media, these image transfer operations are carried out by utilizing heat in a non-electrostatic manner, deteriorations of image qualities which are caused by the disturbance of transfer electric fields and the Coulomb's repulsion can hardly occur.

Furthermore, in the above-described non-electrostatic image forming methods by such a simultaneous image transferring/fixing method, U.S. Pat. No. 2,990,278, JP-A-5-19642, JP-A-5-107950, and JP-A-5-249798 have described the following methods. That is, in order to transfer a toner image formed on an image carrier such as an intermediate transfer member and a photosensitive drum onto a recording medium under better condition, while the image carrier is made in close contact to a recording medium, heat and pressure are applied to this image carrier. Thereafter, both the image carrier and the recording medium are cooled while this image carrier is made in contact with the recording medium, so that a toner image sandwiched between the image carrier and the recording medium is made solid, and also, this solidified toner image is fixed on the recording medium. Then, the toner image fixed on this recording medium is exfoliated from the image carrier.

In accordance with this method, after cohesive power produced among the mutual toners which are penetrated into the recording medium becomes larger than adhesive power produced between the toners and the image carrier, since the toners are separated from the image carrier, a so-called "offset" (namely, a portion of toners are left on image carrier) can be prevented, oilless toner separations can be realized, and furthermore, the transfer efficiency of these toners can be increased, so that the images having better color balance can be obtained. In addition, since the toners are made solid along the surface of the image carrier, such high-quality images having high-class feelings can be produced, while unform glossy feelings can be realized and superior transparent characteristics of the toners can be obtained.

However, in order to obtain such a high-quality image, even after the toner image has been simultaneously transferred/fixed to/on the recording medium, cooling operations of both the intermediate transfer member and the recording medium are required while this intermediate transfer member is made in close contact to the recording medium. When the recording medium is exfoliated from the intermediate transfer member before the toners sandwiched between the recording medium and the intermediate transfer member are cooled to be solidified, the toners of an exfoliated portion of this recording medium are not made solid along either the surface of the intermediate transfer member or the surface of the photosensitive drum, but concave/convex portions are formed. As a result, the glossy feelings are deteriorated. Therefore, there is a difference in the glossy feelings between the close-contacted portion and the exfoliated portion, and fluctuations in the glossy feelings may occur as the entire image, so that the image quality is considerably deteriorated. More specifically, in the case that a breathability of a recording medium is low, that is, an air permeability of a recording medium is high, for example, double-sided coated paper for printing, this exfoliation may occur. The reason why such an exfoliation occurs is given as follows. That is, water components contained in the coated paper are heated to be vaporized and expanded, and then, the vapor components pass through the coated layer to fall out from the coated paper. The water vapor which has been penetrated into the space in the side of the intermediate transfer member is stayed between this intermediate transfer member and the coated layer of the coated paper. Thus, the coated paper is eventually exfoliated from the intermediate transfer member by this water vapor pressure. This phenomenon will be referred to as an "exfoliation blister" hereinafter.

FIG. 1 is a diagram for illustratively showing an occurrence condition of an exfoliation blister.

In FIG. 1, four sets of rectangle-shaped toner images 110 are arranged in such a manner that these four toner images 110 are separated from each other in a slight interval. An exfoliation blister 111 occurs while a non-image portion (namely, paper portion) corresponding to a center portion of the four arranged toner images 110 is positioned as a center.

FIG. 2 and FIG. 3 are diagrams for illustratively showing a mechanism by which the exfoliation blister occurs.

As indicated in FIG. 2, while paper 112 is overlapped with an intermediate transfer belt 113 which carries thereon the toner image 110, heat and pressure are applied to this paper 112 in a heat/pressure-applying unit (not shown). As a result, water components 114 contained inside this paper 112 are heated to be vaporized.

As indicated in FIG. 3, vaporized water components (namely, water vapor) 114*a* will fall out from the internal portion of this paper 112 to an external area. At this time, when this paper 112 corresponds to such a paper whose air permeability is small and which can easily penetrate therethrough air, the vaporized water components 114*a* may fall out from the rear surface of this paper. However, in the case of such a paper whose air permeability is large, for example, double-sided coated paper for printing, water vapor 114*a* may relatively gently fall out from the both surfaces of this paper 112. As a result, such water vapor 114*a* which has fallen out on the side of the intermediate transfer belt 113 is stayed at a region where the toner image 110 is not formed. Then, this water vapor pressure is increased, and while the paper 112 is deformed, the paper 112 is exfoliated from the intermediate transfer belt 113, so that a so-called "exfoliation blister" 111 may occur.

A phenomenon called as a "paper blister" which is resembled to the above-described exfoliation blister 111 is such a phenomenon which may occasionally occur in the conventional printing systems and the fixing systems, which have been utilized many times. That is, in this paper blister phenomenon, since the water vapor 114*a* which has been enclosed in the coated layer of the coated paper is stayed within the coated layer, the interior portion of the paper will blister, so that paper fiber may be destroyed.

With respect to this paper blister phenomenon, various conventional techniques capable of adjusting air permeabilities of paper itself have been proposed. That is, the averaged center line roughness of the surface of the coated layer is adjusted smaller than, or equal to 20 $\mu$m, and further, the air permeability is adjusted shorter than, or equal to 4000 seconds (see JP-A-62-198876, and JP-B-5-82940). Also, the coated layer having the better water vapor permeability, the coated amount of which is selected to be 2 to 5 (g/m$^2$), is provided on both surfaces of the original paper having the specific air permeability, while the water vapor transmission ratio has been adjusted within the range between 50 and 500 (g/m$^2$×24 hours) (see JP-A-1-245265).

However, the exfoliation blister may very easily occur, as compared with the paper blister. Thus, even when such a coated paper is employed whose air permeability has been adjusted so as to suppress an occurrence of a paper blister phenomenon, an exfoliation blister phenomenon may occur. Also, very recently, even in electro-photographic type image forming apparatus, no-dependable characteristics of paper sorts are required. More specifically, in order to satisfy needs made in a light printing field, for instance, on-demand publishing, adaptability characteristics of such electro-photographic type image forming apparatus to double-sided coated paper are necessarily required. The above-described solving means could not constitute such a proper solving means capable of solving the occurrence of this exfoliation blister phenomenon.

On the other hand, JP-A-9-330006 discloses the following technique. That is to say, both the recording medium and the image carrier which sandwich the toner image and to which heat and pressure have applied are cooled in such a way that these recording medium and image carrier are solidified on the cooling member whose surface is curved in the convex form. Furthermore, both the recording medium and the image carrier are pressure-depressed by the depressing means arranged opposite to this cooling member, so that the image carrier and the recording medium which sandwich the toner image are made in close contact to each other, and also both this image carrier and this recording medium which are brought into such a close contact condition are cooled so as to make the toner image solid. As a consequence, this conventional technique is capable of preventing deviation and exfoliation between the image carrier and the recording medium, or is capable of avoiding a floating phenomenon of the recording medium. Moreover, this conventional technique is capable of avoiding occurrences of offset, image fluctuations, and glossy fluctuations.

In accordance with this structure, such a mechanical deformation as the deviation, exfoliation, and floating between the image carrier and the recording medium can be prevented.

However, since an occurrence of such an exfoliation phenomenon is caused by vaporization of water components contained in paper, the temperature of this paper is high just after this paper has passed through the heat/pressure applying unit, and thus, a relatively large amount of water vapor existed between the image carrier and the recording medium may fall out from the paper, so that this paper may be deformed. As a result, when this paper reaches-the depressing member which is arranged opposite to the cooling member and is disclosed in JP-A-9-330006, a very large amount of water vapor has already fallen out and the paper has been deformed. As a consequence, it is practically difficult that the water vapor which has already fallen out is returned to this paper, the deformed paper is corrected, and further the contact condition between the image carrier and the recording medium is returned to the close contact condition. In other words, in order that the contact condition between the image carrier and the recording medium is returned to the close contact condition, sufficiently strong depression force is required. Since the depression operation by the depressing member is carried out against the cooling member which is solidified on the image carrier, if the sufficiently strong depression force is applied to both the recording medium and the image carrier, the load becomes excessively large. As a consequence, there are such problems that the drive control operation can be hardly carried out, and also the image carrier is worn away, which may impede long lifetime of this image carrier.

To preventing the occurrence of the exfoliation blister, while avoiding this problem, JP-A-2001-166610 opens such a technique that both the image carrier and the recording medium are sandwiched by the depressing unit constituted by the two roller-shaped members which are arranged on the upper stream side of the cooling member so as to return the contact condition between the image carrier and the recording medium to the close contact condition.

In accordance with these conventional techniques, since the depression operation is performed against the follow-actuated counter member, even in such a case that pressure is applied which is required to return the contact condition to the close contact condition, it is possible to avoid such a problem that the drive control operation cannot be carried out and the image carrier is worn away.

However, these technical ideas can hardly return a large amount of water vapor which has once fallen out to the paper, and can hardly return the contact condition to the close contact condition after the deformation of this paper has been reformed. Even if the contact condition can be returned to the close contact condition, then there is a positional shift between the original close-contact position and the close-contact position where the paper has been once exfoliated from the original close-contact position and thereafter this paper is again made in the close contact therewith. As a result, there are other problems that images are positionally shifted, and the deformed trail of this paper is lefted. Also, in such a case that the temperatures of both the image carrier and the recording medium are not yet decreased just after the recording medium has passed through the depressing unit, another exfoliation blister caused by water vapor may again occur after the paper has passed this depressing unit.

On the other hand, JP-A-5-142959 discloses the below-mentioned technique related to the belt fixing device. That is, the paper which carries thereon the unfixed toner image is sandwiched from both the front surface and the rear surface by the endless belt containing both the heat-applying roller and the exfoliating roller for the front surface side, and also the endless belt containing both the pressure-applying roller and the exfoliating roller for the rear surface side, and then, the paper is overlapped with these endless belts. Both heat and pressure are applied to the toner image by both the heat-applying roller and the pressure-applying roller. Then, the toner image is cooled under such a condition that this toner image is overlapped on the endless belts so as to be fixed on the paper. The toner image which has been fixed from the endless belts to the paper is exfoliated at the positions of the two exfoliation rollers located opposite to each other, so that the highly gloss images may be obtained with respect to both the front surface and the rear surface in the case of the double-plane (dual-plane) printing. In accordance with this disclosed technique, the member having the curve "R" abuts from one of the endless belts under overlapped condition at the position from the heat/pressure-applying position up-to the exfoliating position, and the close contact condition is established between the recording medium and the fixing belts by way of tension of these endless belts, so that occurrences of paper wrinkles (cockles) can be prevented.

However, when information is print out on double-sided coated paper for printing by employing the belt fixing device disclosed in JP-A-5-142959, substantially no deformed trail of this double-sided coated paper which is caused by the exfoliation blister can be recognized, but glossy fluctuations still remain.

The reason why such a glossy fluctuation is still left may be conceived as follows: That is, just after the double-sided coated paper for printing has passed through the heat/pressure-applying unit, the water vapor may fall out into a space defined between the endless belt and the recording medium. The deformation of this double-sided coated paper may be suppressed to a minimum deformation amount due to rigid characteristics of the rear-surface-sided endless belt, and also the amount of water vapor which falls out is also limited. However, a slight space may be produced between both the front-surface-sided and rear-surface-sided endless belts, and the recording medium. As a consequence, while utilizing only such effects achieved by the tension of these endless belts, which are described in JP-A-5-142959, the water vapor which has fall out into the space cannot be sufficiently returned to the recording medium, the recording medium foliated from the endless belt cannot be sufficiently returned to the close contact condition, but also the glossy fluctuations formed in the toner image cannot be sufficiently connected.

SUMMARY OF THE INVENTION

In view of the above-described circumstance, an object of the present invention is to provide an image forming apparatus and a fixing apparatus in which a high quality image without exfoliation blister even when a recording medium having high air permeability such as double-sided coated paper for printing is used in a simultaneous image transferring/fixing type image forming apparatus using a belt-shaped image carrier or in a fixing unit using a belt-shape fixing member.

To achieve the above-described object, according to a first aspect of the invention, there is provided an image forming apparatus including an image carrying body for carrying a toner image thereon and moving in a predetermined travel direction, a heating unit for heating the image carrying body to melt the toner image on the image carrying body, a pressure unit for overlapping a recording medium with the image carrying body while the toner image melted by the heating unit is sandwiched between the recording medium and the image carrying body, the pressure unit for applying pressure at a pressure position to the recording medium and the image carrying body, which are overlapped with each other, a recording medium supporting member moving in the predetermined travel direction from the pressure position to an exfoliation position while supporting the recording medium overlapped with the image carrying body, and a depressing/close-contacting unit for sandwiching and depressing the recording medium supporting member and the image carrying body in a middle position between the pressure position and the exfoliation position to closely contact the recording medium with the image carrying body. After the pressure unit applies pressure, an image is formed on the recording medium by exfoliating the recording medium from the image carrying body at the exfoliation position.

Preferably, the recording medium supporting member is an endless-shaped flat belt and a modulus of rigidity per unit width of the endless-shaped flat belt is not smaller than $0.8\times10^{-6}$ kgm$^2$.

Also preferably, the depressing/close-contacting unit sandwiches and depresses the recording medium supporting member and the image carrying body at a place where the recording medium has a temperature not higher than 125° C. and the toner image sandwiched between the recording medium and the image carrying body has a viscosity coefficient not larger than $10^5$ Pa·s.

Also preferably, the depressing/close-contacting unit includes at least one depressing portion having a roll-shape depressing member and a facing member facing the depressing member. The depressing member sandwiches and depresses the recording medium supporting member and the image carrying body so that pressure applied to the recording medium supporting member and the image carrying body is not lower than $2\times10^4$ Pa.

To achieve the object of the invention, according to a second aspect of the invention, there is provided a fixing apparatus including a fixing belt moving in a predetermined direction, a heating/pressuring unit having a pair of rollers sandwiching the fixing belt and being opposed to each other to form a nip portion, the heating/pressuring unit for overlapping the recording medium with the fixing belt while sandwiching a toner image between the recording medium and the fixing body to sandwich the recording medium and the fixing belt by the nip portion and for heating and applying pressure to the recording medium and the fixing belt at a heating position, a recording medium supporting member moving in the predetermined direction from the pressure position to an exfoliation position while supporting the recording medium overlapped with the fixing belt, and a depressing/close-contacting unit for sandwiching and depressing the recording medium supporting member and the fixing belt in a middle position between the pressure position and the exfoliation position to closely contact the recording medium with the fixing belt. After the heating/pressuring unit heats and applies pressure, an image is formed on the recording medium by exfoliating the recording medium on which the toner image is fixed from the fixing belt at the exfoliation position.

Preferably, the recording medium supporting member is an endless-shaped flat belt and a modulus of rigidity per unit width of the endless-shaped flat belt is not smaller than $0.8\times10^{-6}$ kgm$^2$.

Also preferably, the depressing/close-contacting unit sandwiches and depresses the recording medium supporting member and the fixing belt at a place where the recording medium has a temperature not higher than 125° C. and the toner image sandwiched between the recording medium and the fixing belt has a viscosity coefficient not larger than $10^5$ Pa·s.

Also preferably, the depressing/close-contacting unit includes at least one depressing portion having a roll-shape depressing member and a facing member facing the depressing member. The depressing member sandwiches and depresses the recording medium supporting member and the fixing belt so that pressure applied to the recording medium supporting member and the fixing belt is not lower than $2\times10^4$ Pa.

DETAILED DESCRIPTION OF THE PREFERRED EMBODIMENTS

Embodiments of the present invention will now be explained hereinbelow.

First, the principle of the invention will be explained.

Figure 1:
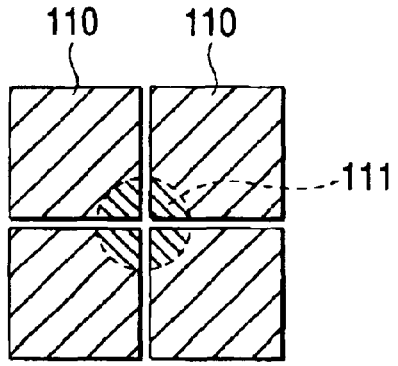
FIG. 1 is a diagram for showing an occurrence condition of an exfoliation blister.
Figure 2:
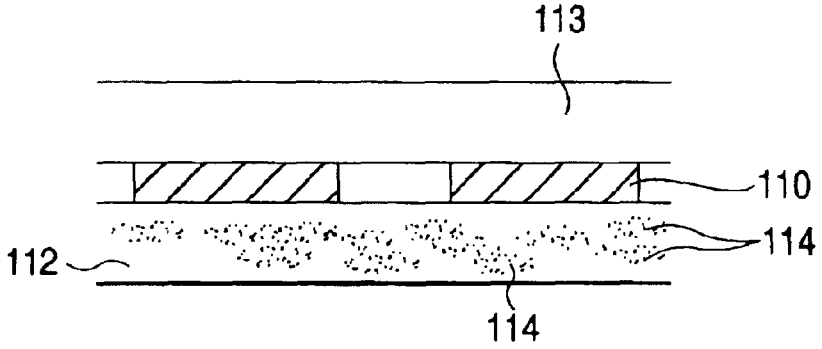
FIG. 2 is a diagram for representing a mechanism why the exfoliation blister occurs.
Figure 3:
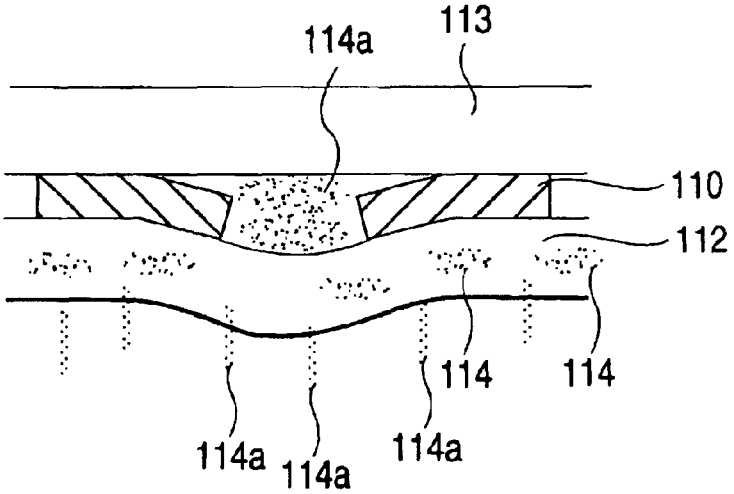
FIG. 3 is a diagram for representing a mechanism as to why the exfoliation blister occurs.
Figure 4:
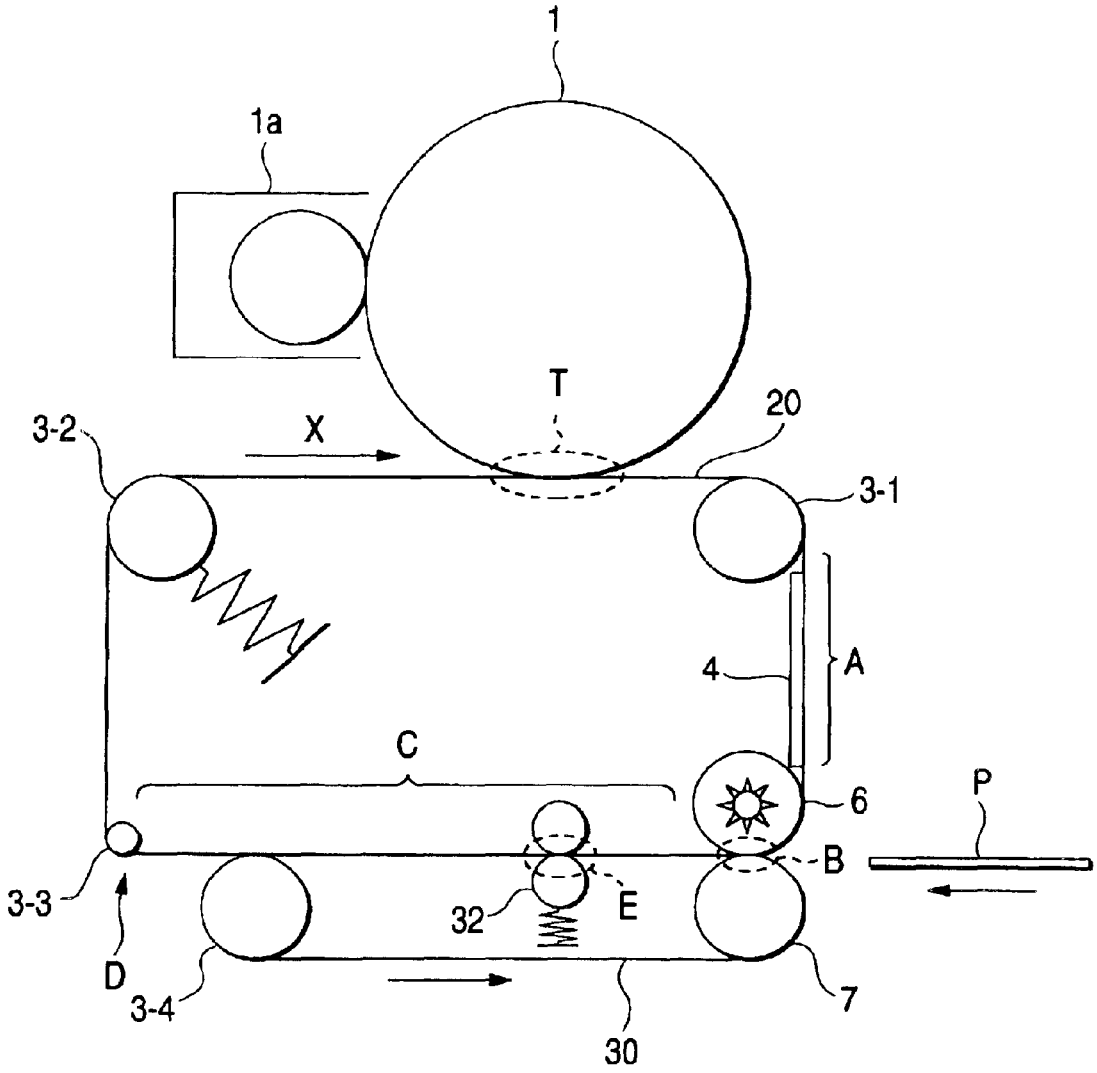
FIG. 4 is a diagram for indicating a schematic structure of an image forming apparatus used to explain a principle of the present invention.

FIG. 4 is a diagram indicating a schematic structure of an image forming apparatus used to describe the principle of the invention.

In FIG. 4, an intermediate transfer belt 20 carries thereon a toner image and is equipped with a photosensitive drum 1 on which the toner image is formed by a developing device 1*a*. The intermediate transfer belt 20 is tensioned over supporting rollers 3-1, 3-2, 3-3, and a heating roller 6. The intermediate transfer belt 20 is transported in a circulation mariner along an arrow X direction, and is made in contact with the photosensitive drum 1 between the supporting roller 3-1 and the supporting roller 3-2 to form a transfer section "T" where the toner image formed on the photosensitive drum 1 is transferred to the intermediate transfer belt 20. A heating unit 4 is provided within a section "A" defined between the supporting roller 3-1 and the heating roller 6. This heating unit 4 is made in contact with a rear surface of the intermediate transfer belt 20, which is located opposite to the toner image transferred onto this intermediate transfer belt 20, and heats the toner image, which has been transferred onto the intermediate transfer belt 20, so as to melt the toner image transferred onto the intermediate transfer belt 20. Also, a recording medium supporting belt 30 is tensioned over both a pressure-applying roller 7 located opposite to the heating roller 6 and the supporting roller 3-4 within a section "C" defined between the heating roller 6 and the supporting roller 3-3. The recording medium supporting belt 30 is transported in a circulation manner with maintaining a parallel condition with respect to the intermediate transfer belt 20. Furthermore, a cooling unit (not shown) and one pair of depressing/close-contacting members 32 are provided within the section "C" to constitute a depressing section "E", while the paired depressing/close-contacting members 32 sandwich and depress the recording medium supporting belt 30 and the intermediate transfer belt 20. The heating roller 6 and the pressure-applying roller 7 apply pressure to the recording medium supporting belt 30 and the intermediate transfer belt 20, and constitute a pressure-applying section "B". The supporting roller 3-3 constitutes an exfoliating section "D", where paper "P" from the intermediate transfer belt 20 is exfoliated.

The toner image formed on the photosensitive drum 1 is transferred onto the intermediate transfer belt 20 in the transfer section T. Then, the toner image on the intermediate transfer belt 20 is heated and melted by the heating unit 4. The toner image melted on the intermediate transfer belt 20 is overlapped with the paper P and is applied pressure at the pressure applying section B. The paper P, which is overlapped with the intermediate transfer belt 20 while sandwiching the toner image between the own paper P and the intermediate transfer belt 20, is supported by the recording medium supporting belt 30 and is cooled by a cooling unit (not shown) Then, the paper is depressed by the depressing/close-contacting members 32 so as to be made in close contact with the intermediate transfer belt 20. The toner image, which has been cooled to be solidified under close contact condition and has been fixed on this paper P, is exfoliated from the intermediate transfer belt 20 at an exfoliating section "D", so that an image made of the fixed toner image is formed on the paper P.

The toners in a powder form which are heated by the heating section "A" are melted to become toners in a film form. Then, the film-formed toners are overlapped with the paper P to be pressure-contacted against the intermediate transfer belt 20 in the pressure applying section B, which is formed by both the intermediate transfer belt 20 and the recording medium supporting belt 30, which are tensioned over the heating roller 6 and the pressure-applying roller 7, respectively. Thus, both the intermediate transfer belt 20 and the paper P are brought into a close contact condition while sandwiching the film-shaped toner image. At this time, in order to perform a heat conducting operation to the toner image in a high efficiency, the close-contact characteristic between the intermediate transfer belt 20 and the paper P constitutes an important factor. When air is penetrated into certain places between the intermediate transfer belt 20 and the paper P without maintaining the close-contact characteristic, heat capacitances of a place where air is present and another place where air is absent are different from each other. As a result, since the toner image is not uniformly melted, an image quality is deteriorated-due to a fluctuation in image transferring/fixing operations and/or a so-called "offset phenomenon". In order to improve the close-contact characteristic between the intermediate transfer belt 20 and the paper P while sandwiching the toner image therebetween, an elastic member layer is formed on a surface of the intermediate transfer belt 20. Also, in order to apply uniform pressure to the intermediate transfer belt 20 and the paper P in the pressure applying section B, which is formed by the heat applying roller 6 and the pressure applying roller 7, elastic member layers are provided on both surfaces of the heating roller 6 and the pressure-applying roller 7.

The toner image which has been made in close contact with the paper P in the pressure applying section B is cooled by the cooling unit (not shown) while being transported to the exfoliating section D to be cohesively solidified, so that strong adhesive force is produced between the paper P and the cohesively-solidified toner imager. It should be noted that the above-described cooling unit (not shown) may be realized by a cooling apparatus (not shown either) provided between the pressure applying section B and the exfoliating section D. Both the intermediate transfer belt 20 and the paper P, which have been cooled by the cooling unit (not shown), are transported to the exfoliating section D constituted by the supporting roller 3-3 having a small radius curvature. Then, the paper P is exfoliated from the intermediate transfer belt 20 together with the toner image due to rigidity of the paper P itself, so that an image is formed. A surface of the image, which has been transferred/fixed onto the paper P, is smoothed in accordance with the surface of the intermediate transfer belt 20 to have high gloss.

While the paper P passes through the pressure applying section B, the paper P is heated by heat conducted from the intermediate transfer belt 20, so that water components contained in the paper P are vaporized and expanded. In the case that the paper P is double-sided coated paper having a higher air permeability, the water components (water vapor) which are vaporized/expanded will fall out from the paper P via the coated layers just after the double-sided coated paper "P" has passed through the pressure applying section B. Among the vaporized/expanded water components, water components which have fallen out to the space on the side of the intermediate transfer belt 20 are stayed between the intermediate transfer belt 20 and the coated layer of the paper P. This water vapor pressure may exert force in a direction along which the paper P is exfoliated from the intermediate transfer belt 20, so that the force will deform the paper P. However, this force may be suppressed to a minimum value due to the rigidity of the recording medium supporting belt 30. A modulus of bending rigidity per unit width of the recording medium supporting belt 30 is selected to be larger than or equal to $0.8\times10^{--6}$ $kgm^2$, the deformation of the paper P just after being pressure-applied can be firmly prevented. Even when the double-sided coated paper for printing is employed, an image having a high image quality can be obtained without any exfoliation blister.

In this case, a modulus of bending rigidity per unit width is equal to a product made by an apparent Young's modulus "E" ($Kg/m^2$) of the recording medium supporting belt 30 and geometrical moment of inertia I ($m^4$) per unit width of the recording medium supporting belt 30. Assuming now that a thickness of the recording medium supporting belt 30 is equal to h(m), the modulus of bending rigidity per unit width is expressed by the following formula (1):

$$\text{modulus of bending rigidity per unit width}=EI=Eh^3/12 \quad (1)$$

Also, the apparent Young's modulus "E" is obtained by multiplying Young's moduli $E_1$, $E_2$, - - - , of materials which constitute the respective layers of this recording medium supporting belt 30 by weights of thicknesses $h_1$, $h_2$, - - - , of the respective layers, respectively, and by averaging the multiplied Young's moduli. The apparent Young's modulus E is expressed by the below-mentioned formula (2):

$$\text{apparent Young's modulus } \text{"}E\text{"}=(E_1h_1+E_2h_2+ - - - )/(h_1+h_2+ - - - ) \quad (2)$$

The paper P which has been overlapped with the intermediate transfer belt 20 while sandwiching the toner image therebetween is furthermore cooled by the cooling unit (not shown). Under such a condition that the toners are being solidified, the depressing section E applies pressure to the intermediate transfer belt 20 by the recording medium supporting belt 30 and the depressing/close-contacting members 32 while sandwiching therebetween the paper P. As a result, since the paper P being exfoliated from the intermediate transfer belt 20 is again made in close contact with the intermediate transfer belt 20, a smoothness of the toner image can be recovered. However, under such a condition that since both the paper P and the intermediate transfer belt 20 are not sufficiently cooled, a space is produced between the intermediate transfer belt 20 and the paper P or a condition that the water vapor pressure within the paper P is high, even if pressure is applied at the depressing section E, the occurrence of the exfoliation blister cannot be suppressed due to the following reasons. Under such conditions, it is difficult to return the water vapor, which has fallen out to the space between the intermediate transfer belt 20 and the paper P, to the paper P, even if the pressure is applied thereto by the pressing unit E. Even if the water vapor can be returned to the paper P, since the water vapor again falls out from this paper P after the paper P passes through the depressing section E, the occurrence of the exfoliation blister cannot be suppressed. Conversely, under such a condition that both the intermediate transfer belt 20 and the paper P are cooled and thus the toner image is completely solidified, even if the pressure is applied to both the intermediate transfer belt 20 and the paper P so as to be made in close contact with each other, then the surface of the toner image cannot again recover smoothness. In order to suppress the occurrence of such an exfoliation blister, both a temperature of the paper P at a position where pressure is applied to the paper P by the depressing section E, and a viscosity coefficient of a toner image at this time are important factors. If pressure is applied to the paper P by the depressing section E under a conditions that upper limit temperature of the paper is 125 ° C., and lower limit temperature of the paper P is present within a temperature range where a toner viscosity coefficient is smaller than, or equal to $10^5$ Pa·s, then the surface of the toner image can be again formed and shaped. Therefore, even when the double-sided coated paper for printing is employed, an image having a high image quality can be obtained without an occurrence of any exfoliation blister phenomenon.

In this case, the temperature of the paper P indicates temperature at a boundary between the paper P and the intermediate transfer belt 20. Now, the temperature of the paper P can be calculated in accordance with the following one-dimensional stationary heat-conduction equation (3) while employing measurement temperature "$T_0$" of a rear surface (a surface opposed to a side with which the paper is overlapped) of the intermediate transfer belt 20, which is measured at a desired position and another measurement temperature "$T_5$" of a rear surface (a surface opposed to a side supporting the paper) of the recording medium supporting belt 30. It is assumed that boundary temperatures of the respective layers are equal to each other.

one-dimensional stationary heat-conduction equation:

$$\delta/\delta x(\kappa\, \delta T/\delta x)=0 \tag{3}$$

where x represents a distance (m) from the paper P in the normal direction, κ represents a coefficient of thermal conductivity (J/° C./m/sec), and T represents a temperature (° C.). In other words, it is so assumed that as to the intermediate transfer belt 20, a thickness of a base layer is "$h_1$", a coefficient of thermal conductivity thereof is "$\kappa_1$"; and a thickness of a surface layer is "$h_2$", a coefficient of thermal conductivity thereof is "$\kappa_2$". Also, it is assumed that as to the paper P, a thickness thereof is "$h_3$" and a coefficient of thermal conductivity thereof is "$\kappa_3$". Furthermore, it is assumed that as to the recording medium supporting belt 30, a thickness of a surface layer is "$h_4$", a coefficient of thermal conductivity thereof is "$\kappa_4$,"; and a thickness of a base layer is "$h_5$", a coefficient of thermal conductivity thereof is "$\kappa_5$." In addition, the below-mentioned relational formula (4) may be established based upon the above-described formula (3) and the above-explained boundary condition, assuming that a temperature of the rear surface of the intermediate transfer belt 20 is "$T_0$"; a boundary temperature between the base layer and surface layer of the intermediate transfer belt 20 is "$T_1$"; a boundary temperature between the surface layer of the intermediate transfer belt 20 and the paper P is "$T_2$"; a boundary temperature between the surface layer of the recording medium supporting belt 30 and the paper P is "$T_3$"; a boundary temperature between the base layer and surface layer of the recording medium supporting belt 30 is "$T_4$"; and a temperature of the rear surface layer of the recording medium supporting belt 30 is "$T_5$". Furthermore, it is so assumed that a flow rate of heat which is conducted through the base layer of the intermediate transfer belt 20 is "$q_1$"; a flow rate of heat which is conducted through the surface layer of the intermediate transfer belt 20 is "$q_2$"; a flow rate of heat which is conducted through the paper P is "$q_3$"; a flow rate of heat which is conducted through the surface layer of the recording medium supporting belt 30 is "$q_4$"; and a flow rate of heat which is conducted through the base layer of the recording medium supporting belt 30 is "$q_5$".

$$q_1=-\kappa_1(T_1-T_0)/h_1,$$

$$q_2=-\kappa_2(T_2-T_1)/h_2,$$

$$q_3=-\kappa_3(T_3-T_2)/h_3,$$

$$q_4=-\kappa_4(T_4-T_3)/h_4,$$

$$q_5=-\kappa_5(T_5-T_4)/h_5,$$

$$q_1=q_2=q_3=q_4=q_5 \tag{4}$$

If these formulae (4) are solved as to the boundary temperature "$T_2$", the boundary temperature between the surface layer of the intermediate transfer belt 20 and the paper P is obtained.

In this case, for example, when the recording medium supporting belt 30 is constituted by a single layer, the formula (3) is applied only to one layer of the recording medium supporting belt 30 so as to calculate a temperature of the paper P. Conversely, when the recording medium supporting belt 30 owns a layer other than the base layer and the surface layer, namely, is constructed of three layers or more layers, the above-described formula (3) is applied to each of the layers, so that a temperature of the paper P can be calculated.

Figure 5:
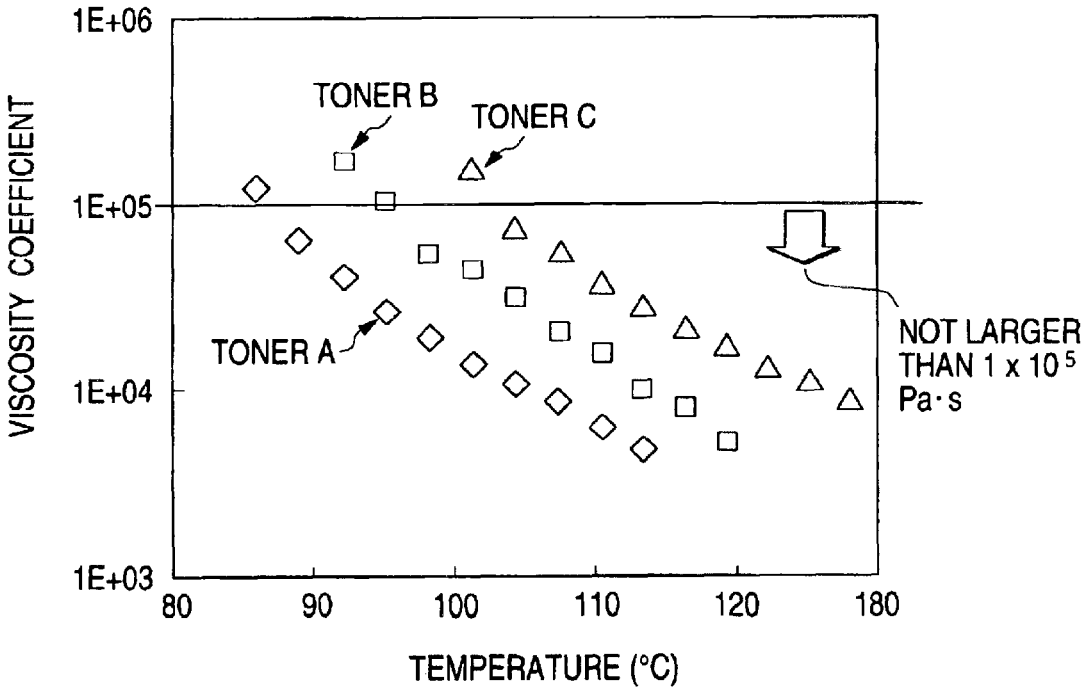
FIG. 5 is a diagram for representing a viscosity coefficient characteristic as to three sorts of polyester toners.

FIG. 5 is a diagram for graphically indicating a toner viscosity coefficient-to-temperature characteristic of three sorts of polyester toners "A", "B", and "C".

An ordinate of FIG. 5 shows a toner viscosity coefficient in a logarithm scale and an abscissa thereof indicates a toner temperature. In the drawing, plotted symbols "◇", "□", "Δ" show values of viscosity coefficients measured under such a measuring condition that a starting temperature is 80° C., a maximum temperature is 170° C., a temperature rising speed is 3° C./min, preheating time is 300 sec, pressure of a cylinder is 98 N/cm$^2$, and a dimension of a die is equal to 1.0 mm×1.0 mm, with a flow tester CFT500C (manufactured by SHIMADZU Corporation).

When this toner viscosity coefficient-to-temperature characteristic is used, a lower limit temperature of the paper P can be calculated under such a condition that the toner viscosity coefficient at a position where the toner is pressure-applied by the depressing/close-contacting members 32 is set to be smaller than, or equal to $10^5$ Pa·s.

Next, a description will now be made of an image forming apparatus according to a first embodiment of the present invention.

Figure 6:
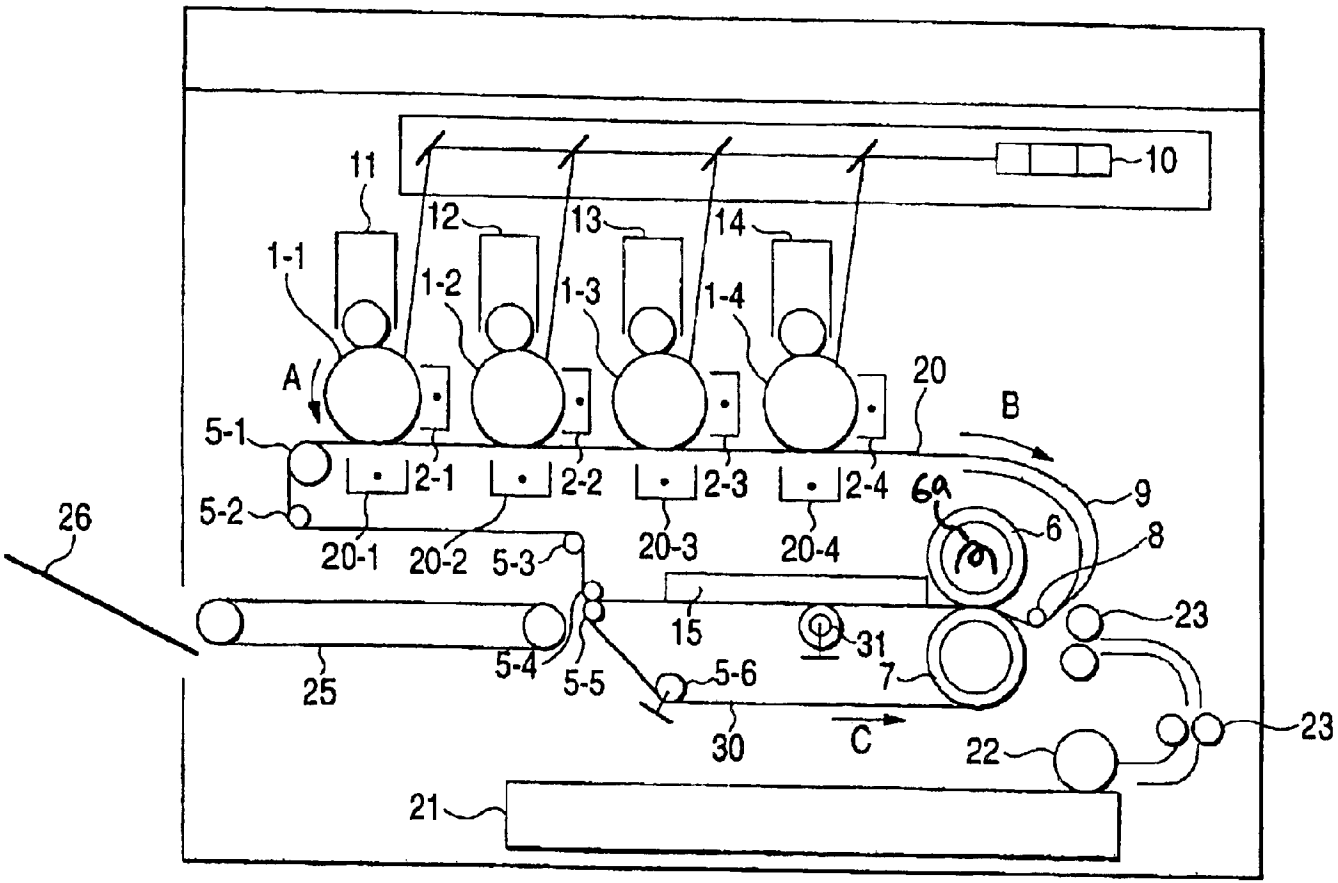
FIG. 6 is a diagram for indicating a schematic structure of an image forming apparatus according to a first embodiment of the present invention.

FIG. 6 is a diagram for schematically indicating a construction of the image forming apparatus according to the first embodiment of the invention.

In the image forming apparatus shown in FIG. 6, an intermediate transfer belt 20 is transported in a circulation manner along an arrow-B direction, while this intermediate transfer belt 20 is supported by supporting rollers 5-1, 5-2, 5-3, 5-4, a heating plate 9, and a position control roller 8. Both a heating roller 6 containing therein a heat source *6a* and a pressure-applying roller 7 are arranged opposite to each other by sandwiching the intermediate transfer roller 20 between these rollers 6 and 7 at a down stream of the position control roller 8 in the arrow-B direction along which the intermediate transfer belt 20 is transported in a circulation manner. The heating plate 9 is constructed of a plate having a heat source, and is arranged in such a manner that since the intermediate transfer belt 20 which is made in contact with the heating plate 9 is heated by this heating plate 9, a toner image formed on this intermediate transfer belt 20 is heated. In this case, the heating roller 6 and the pressure-applying roller 7 may be arranged in an opposite manner to the above-described roller arrangement, and the pressure-applying roller 7 may contain a heat source.

Four sets of photosensitive drums 1-1-, 1-2, 1-3, 1-4, which are series-arranged and are rotated along an arrow-A direction are made in contact with the intermediate transfer belt 20. Each of these four photosensitive drums 1-1, 1-2, 1-3, 1-4 is uniformly charged by each of charging devices 2-1, 2-2, 2-3, 2-4, and thereafter, is exposed by an optical beam scanning apparatus 10 for turning ON/OFF an optical beam which is modulated by a pulse width modulation (PWM) in response to a concentration signal. Thus, electrostatic latent images are formed on the respective photosensitive drums 1-1-, 1-2, 1-3, 1-4. The electrostatic latent images formed on the respective photosensitive drums 1-1, 1-2, 1-3, 1-4 are developed by respective developing devices 11, 12, 13, 14, into which a black (K) toner, a yellow (Y) toner, a magenta (M) toner, and a cyan (C) toner have been stored. The respective color toner images are formed on the respective photosensitive drums 1-1, 1-2, 1-3, 1-4, and these color toner images have been processed by digital image processing operation in which concentration is represented, depending upon areas. These color toner images are sequentially transferred onto the intermediate transfer belt 20 in a multiple manner by activating transfer devices 20-1, 20-2, 20-3, 20-4, which are positioned opposite to the respective photosensitive drums 1-1, 1-2, 1-3, 1-4 by being separated from the intermediate transfer belt 20, so that a toner image having plural colors are formed on the intermediate transfer belt 20. Then, the toner image having the plural colors, which has been formed on the intermediate transfer belt 20, is heated by the heating plate 9 to be melted.

On the other hand, paper "P" which is taken out from a paper tray 21 by a take-up roller 22 and then is transported by a transport roller 23 is carried to a nip portion in adjusted timing so as to be overlapped with the toner image having the plural colors formed on the intermediate transfer belt 20. Then, pressure and heat are applied to this toner image and the paper P. This nip portion is arranged in opposite to both the heating roller 6 and the pressure-applying roller 7 by sandwiching both the intermediate transfer belt 20 and the recording medium supporting belt 30. The toner image having the plural colors which has been heated at a temperature higher than, or equal to a melting temperature is penetrated into recording paper P. Then, the intermediate transfer belt 20 under such a condition that this intermediate transfer belt 20 is overlapped with the paper P while sandwiching this toner image having the plural colors is cooled by a cooling unit 15, so that the toner image having the plural colors are cohesively solidified to be strongly be fixed on the paper P. On the other, while a recording medium supporting belt 30 which is tensioned over the pressure-applying roller 7 and the supporting roller 5-5 and 5-6 supports the paper P, this recording medium supporting belt 30 is transported in a circulation manner along an arrow-C direction identical to the transporting direction of the intermediate transfer belt 20. This paper P is overlapped with the intermediate transfer belt 20 by rigid characteristic thereof between the heating roller 6 and the supporting roller 5-4. Also, a depressing/close-contacting roller 31 is provided between the heating roller 6 and the supporting roller 5-4. This depressing/close-contacting roller 31 depresses both the recording medium supporting belt 30 and the intermediate transfer belt 20 on the side of the cooling unit 15 corresponding to a counter member so as to make the paper P in close contact to the intermediate belt 20.

In this case, the recording medium supporting belt 30. is an endless type flat belt, and a modulus of rigidity per unit width of this flat belt is larger than, or equal to $8\times10^{-6}$ kgm$^2$.

Just after heat and pressure have been applied to the recording paper P by the heat roller 6 and the pressure-applying roller 7, water components contained in the recording paper P are vaporized, so that water vapor will fall out to a space made between the intermediate transfer belt 20 and the recording paper P. However, deformation of the recording paper P may be suppressed to a minimum deformation due to rigidity of the recording medium supporting belt 30. Also, the recording paper P is cooled by the cooling unit 15 at a temperature lower than, or equal to 125° C., so that water vapor pressure may be lowered. Moreover, the depressing/close-contacting roller 31 is arranged at such a position where a viscosity coefficient of the toner image sandwiched by the recording paper P and the intermediate transfer belt 20 becomes lower than, equal to $10^5$ Pa·s. When the toner image is brought into a melting condition before being solidified, the depressing/close-contacting roller 31 depresses the recording medium supporting belt 30 against the counter side of the cooling unit 15 in order to make the recording paper P in close contact to the intermediate transfer belt 20, whereby the toner image may be reconstructed in a smooth manner. Since the cooling unit 15 is employed as the counter member of the depressing/close-contacting roller 31, in this embodiment, the arranging position of the depressing/close-contacting roller 31 may be adjusted to a proper position by utilizing such a fact that the temperature is decreased while the depressing/close-contacting roller 31 is positionally shifted along the transport direction of the intermediate transfer belt 20.

The cooling unit 15 is employed to cool both the intermediate transfer belt 20 and the recording paper P, which are transported while being overlapped with each other. Thus, the toner image sandwiched between the intermediate transfer belt 20 and the recording paper P is cohesively solidified, so that strong adhesive force may be produced between the recording paper P and the toner image. The recording paper P while being overlapped with the intermediate transfer belt 20 is supported by the recording medium supporting belt 30 and is transported in a circulation manner. The recording paper P on which the toner image has been fixed is exfoliated from the intermediate transfer belt 20 by way of the supporting roller 5-4 whose radius curvature is small due to rigidity owned by this recording paper P, and also this recording paper P is separated from the recording medium supporting belt 30 by the supporting roller 5-5 whose radius curvature is small, so that a color image maybe formed on this recording paper P. A surface of the color toner image which has been transferred/fixed on the recording paper P may be smoothed to become higher gloss in accordance with the surface of the intermediate transfer belt 20.

In this case, as the intermediate transfer belt 20, such an intermediate transfer belt having a two-layer structure made of a base layer and a surface layer may be employed. As the base layer, a polyimide film having a thickness of 50 $\mu$m is employed into which carbon black has been added. In this embodiment, in order that the toner images may be electrostatically transferred from the respective photosensitive drums 1-1, 1-2, 1-3, 1-4 to the intermediate transfer belt 20 without causing any image disturbance, a volume resistivity of the base layer is set to $10^{10}$ Ωcm by adjusting an adding amount of carbon black. As the base layer, for instance, such a sheet having a thickness of 10 to 300 $\mu$m and also a high heat resistivity may be used. That is, as the base layer, polymer sheets maybe used, for instance, polyester, polyethylene telephthalate, polyether sulfon, polyether ketone, poly sulfon, polyimide, polyimide/amide, polyamide, and the like may be employed. Also, in order that the toner images may be electrostatically transferred from the respective photosensitive drums 1-1, 1-2, 1-3, 1-4 to the intermediate transfer belt 20 without causing any image disturbance, a volume resistivity of the surface layer is set to $10^{14}$ Ωcm. Also, when a toner image is transferred from the intermediate transfer belt 20 to the paper P to be fixed on this paper P, a silicone copolymer is employed in order to improve the close-contacting characteristic between the intermediate transfer belt 20 and the paper P by sandwiching the toner image. Since this silicone copolymer owns such a characteristic that the silicone copolymer owns an elastic characteristic; when a surface temperature of this silicon copolymer is the ordinary temperature, this silicone copolymer represents an adhesive characteristic; and furthermore, this silicone copolymer owns a characteristic capable of easily exfoliating the melted toner, this silicone copolymer can effectively transfer the toners to the paper P. As a result, this silicone copolymer is most suitably used as the surface layer. In this embodiment, DX 35-547 A/B silicone copolymer (manufactured by TOREI-DOW SILICONE) whose rubber hardness is 47 degrees and which has a thickness of 80 μm is employed as the surface layer.

As the respective photosensitive drums 1-1, 1-2, 1-3, 1-4, various sorts of inorganic photosensitive drums (Se, a-Si, a-SiC, CdS etc.), and various sorts of organic photosensitive drums may be employed.

A diameter of an optical beam employed in the optical beam scanning apparatus 10 is selected to be 45 μm. A screen may be carried out by employing a vertical normal line, and a line number is 200 line/inch.

The charging devices 20-1, 20-2, 20-3, 20-4 apply electron charges to the rear surface of the intermediate transfer belt 20 so as to apply such an electric charge density by which the toner images formed on the respective photosensitive drums 1-1, 1-2, 1-3, 1-4 may be effectively transferred to the intermediate transfer belt 20. In this embodiment, while corotron is employed, a voltage applied to a corotron wire is controlled in such a manner that such an electric charge density of 315 $\mu C/m^2$ may be applied to the rear surface of the intermediate transfer belt 20.

The heating plate 9 may be a silicone rubber heater mounted on a rear surface of an aluminum plate having a thickness of 2 mm and a length of 220 mm along the circulation direction of the intermediate transfer belt 20. A heating temperature is set in such a controlling manner that the heating temperature becomes higher than, or equal to a melting temperature of a toner image formed on the intermediate transfer belt 20. In this embodiment, a "melting temperature" of a toner implies such a temperature when a viscosity coefficient of the toner becomes $10^3$ Pa·S measured by the below-mentioned measuring method. Alternatively, as the heating plate 9, a ceramic heater may be employed.

As both the heating roller 6 and the pressure-applying roller 7, such a roller may be employed in which a heat-resisting elastic layer such as silicon rubber is used to cover a metal roller. In this embodiment, silicon rubber having a hardness of 45 degrees is stacked in a thickness of 2 mm on a hollow roller made of aluminum to manufacture a roller whose outer diameter is 50 mm. Also, outer diameters, hardness of surface elastic layers, and thickness as to both the heating roller 6 and the pressure-applying roller 7 are selected in such a manner that the nip portion may become a flat plate shape. A weight may be adjusted in such a manner that a nip width becomes 7 mm. In this embodiment, a halogen lamp is positioned within the heating roller 6 so as to constitute the heat source. This heat source may be arranged in the pressure-applying roller 7. Alternatively, such a heat source may not be arranged in both the heating roller 6 and the pressure-applying roller 7.

In this case, as the recording medium supporting belt 30, such a recording medium supporting belt having a two-layer structure made of a base layer and a surface layer may be employed. As the base layer, for instance such a heat-resisting sheet having a thickness of 20 to 300 μm may be used. That is, as the base layer, polymer sheets may be used, for instance, polyester, polyethylene telephthalate, polyether sulfon, polyether ketone, poly sulfon, polyimide, polyimide/amide, polyamide, and the like may be employed. In this embodiment, a polyimide film having a thickness of 20 to 100 μm is employed. As the surface layer, such a member having a better mold releasing characteristic may be employed in order that a toner image formed on a rear surface is not left on the recording medium supporting belt 30 in the case of a double-surface printing operation. In this embodiment, Teflon (registered trademark) AF type 2400 (manufactured by Du Pont) having a thickness of 3 μm is employed as the surface layer.

As the depressing/close-contacting roller 31, such a roller may be employed in which a heat-resisting elastic layer such as silicon rubber is used to cover a metal roller. In this embodiment, silicon rubber having a hardness of 30 degrees is stacked in a thickness of 2mm on a hollow roller made of aluminum to manufacture a roller whose outer diameter is 30 mm. Also, plural sets of this depressing/close-contacting roller 31 may alternatively be employed. In this case, these plural depressing/close-contacting rollers 31 are arranged in a continuous manner along the circulation transport direction B of the intermediate transfer belt 20, and these depressing/close-contacting rollers 31 abut against the counter members. Alternatively, a heat source may be arranged inside the depressing/close-contacting roller 31, and a heating-temperature of this heat source may be set in such a control manner that a toner viscosity coefficient at a depressed nip area becomes smaller than, or equal to $10^5$ Pa·s. In this embodiment, the depressing/close-contacting roller 31 is employed as a depressing/close-contacting unit. This depressing/close-contacting unit is not always realized by a roller, but may be realized by a pad which may be slid to the recording paper, by which a wider range thereof may be depressed by such a pad. Also, in this alternative case, a heat source such as a heater is arranged and a heating temperature may be set/controlled.

In this embodiment, the cooling unit 15 is employed as the counter member. Alternatively, any members other than this cooling unit 15 may be employed as this counter member. Also, a metal material and a high polymer material, the friction resistances of which are reduced, may be slid/contacted to the rear surface of the intermediate transfer belt 20. Alternatively, a roller-shaped member may be employed so as to be followed to the intermediate transfer belt. Also, both a heater and a lamp may be provided in such a manner that a temperature of the paper P at a depressing place may become a proper temperature.

As to the toner, materials known in this technical field may be employed which are constructed of thermoplastic binders containing dyes such as yellow, magenta, cyan dyes.

In this embodiment, such a toner is employed, the averaged particle diameter of which is selected to be 5 μm. Either the exposing condition or the developing condition may be set in such a manner that the respective amounts of color toners formed on the recording medium become approximately 0.3 $mg/cm^2$ to 0.6 $mg/cm^2$ in response to dye containing amounts. In this embodiment, the toner amounts of the colors are commonly set to 0.45 $mg/cm^2$.

Next, a description is made of results which were obtained by evaluating exfoliation blisters with employment of the image forming apparatus according to this embodiment.

Table 1 represents evaluation results of the exfoliation blisters in the case that the temperature at the depressing position was changed.

TABLE 1

| | | temperature (° C.) of paper at depressing position | | | | | | |
|---|---|---|---|---|---|---|---|---|
| paper sort | toner sort | 75 | 85 | 95 | 105 | 115 | 125 | 135 |
| double-surface coated paper | toner A | x | ○ | ○ | ○ | ○ | ○ | x |
| | toner B | x | x | ○ | ○ | ○ | ○ | x |
| | toner C | x | x | x | ○ | ○ | ○ | x |
| J-paper | toner A | ○ | ○ | ○ | ○ | ○ | ○ | ○ |
| | toner B | ○ | ○ | ○ | ○ | ○ | ○ | ○ |
| J-coated paper | toner C | ○ | ○ | ○ | ○ | ○ | ○ | ○ |

In the table 1, symbol "○" shows such a condition that an exfoliation blister does not occur, and symbol "×" represents such a condition that an exfoliation blister occurs.

The evaluation of the exfoliation blister was carried out under the following conditions.

With respect to the recording paper P, as double-sided coated paper for printing, three sorts of the following coated paper were employed, namely SD Lustro Gloss (manufactured by Warrent Inc.), OK TOPCOAT (manufactured by OJI SEISHI K.K.), and Consort Royal Silk (Donside Paper Inc.). A ten-point average thickness of SD lustro Gloss was 100 $\mu$m, an air permeability thereof was 15260 seconds, and a basis weight thereof was 122 g/m$^2$. Also, a ten-point average thickness of OK TOPCOAT was 136 $\mu$m, an air permeability thereof was 44070 seconds, and a basis weight thereof was 157 g/m$^2$. Further, a ten-point average thickness of Consort Royal Silk was 159 $\mu$m, an air permeability thereof was 13910 seconds, and a basis weight thereof was 170 g/m$^2$. Also, as normal paper, J-paper (manufactured by Fuji Xerox company) is employed, and as surface smoothed paper, J-coated paper (manufactured by Fuji Xerox company) is used. A ten-point average thickness of J-paper was 96 $\mu$m, as air permeability thereof was 9 seconds, and a basis weight thereof was 82 g/m$^2$. Also, a ten-point average thickness of J-coated paper was 102 $\mu$m, an air permeability thereof was 367 seconds, and a basis weight thereof was 95 g/m$^2$.

While a transport speed (namely, transferring/fixing speed) of the intermediate transfer belt 20 is selected to be 350 mm/s and the above-explained three sorts of toners are used, images were outputted to Lustro Gloss, OK TOPCOAT, Consort Royal Silk, normal paper (J-paper), and surface-smoothed paper (J-coated paper), and then, evaluations as to exfoliation blisters were carried out. At this time, as the recording medium supporting belt 30, a polyimide film having-a thickness of 70 $\mu$m was employed as the base layer, and Teflon AF type 2400 (manufactured by Du Pont) having a thickness of 3 $\mu$m was used as the surface layer. As to the pressure-applying position by the depressing/close-contacting roller 31, such a position was selected where a temperature of paper was changed by 10° C. within a temperature range between 75° C. and 135° C. The load was adjusted in such a manner that pressure at the nip portion was equal to $5\times10^4$ Pa.

In this specification, the temperature of the paper P implies such a temperature at a boundary between the paper P and the intermediate transfer belt 20. In this embodiment, as to the intermediate transfer belt 20, the base layer made of the polyimide film has a thickness of $h_1=50\times10^{-6}$ (m), and a coefficient of thermal conductivity $\kappa_1=0.174$ (J/° C./m/sec), and also the surface layer made of silicone copolymer has a thickness of $h_2=80\times10^{-6}$(m), and a coefficient of thermal conductivity $\kappa_2=0.280$ (J/° C./m/sec). Also, as to the paper p, for example, J-paper has a thickness of $h_3=102\times10^{-6}$(m), and a coefficient of thermal conductivity $\kappa_2=0.126$ (J/° C./m/sec). Furthermore, as to the recording medium supporting belt 30, the surface layer made of Teflon AF type 2400 (manufactured by Du Pont) has a thickness of $h_4=3\times10^{-6}$(m), and a coefficient of thermal conductivity $\kappa_4=0.240$ (J/° C./m/sec), and also the base layer made of the polyimide film has a thickness of $h_5=70\times10^{-6}$(m), and a coefficient of thermal conductivity $\kappa_5=0.174$ (J/° C./m/sec). As a consequence, these numeral values were substituted for the above-described formula (4), so that a formula (5) capable of calculating a boundary temperature $T_2$ between the paper P and the intermediate transfer belt 20 could be obtained.

$$T_2=0.68\ T_0+0.32\ T_5 \tag{5}$$

Then, the temperature "$T_0$" at the rear surface of the intermediate transfer belt 20 was measured by embedding a thermal junction (thermocouple device) in a contact place between the cooling unit and the intermediate transfer belt 20 at each of measuring positions, whereas the temperature "$T_5$" at the rear surface of the recording medium supporting belt 30 was measured by using an infrared radiation temperature meter. Then, these temperature measurement results were substituted for the above formula (5) so as to obtain the boundary temperature $T_2$.

As apparent from the table 1, in the case that double-sided coated paper for printing was employed, the air permeability of which is larger than, or equal to 10,000, the occurrence of the exfoliation blister could be suppressed and the image having the better image quality could be obtained only under the following conditions. That is, the depressing/close-contacting unit was arranged at such a place where an upper limit temperature of the double-sided coated paper was 125° C., and furthermore, such a temperature that a viscosity coefficient of each of the toners A, B, C shown in FIG. 5 becomes smaller than, or equal to $10^5$ Pa·S was set as a lower limited temperature, and also the depressing/close-contacting unit applied pressure to the double-sided coated paper.

Furthermore, in the above-described arrangement, while the modulus of bending rigidity of the recording medium supporting belt 300 was changed, an image was outputted by using the toner B with respect to three sorts of the above-explained double-sided coated paper for printing, and then the evaluation as to the exfoliation blister was carried out.

Table 2 represents an evaluation result of exfoliation blisters in the case that the modulus of bending rigidity of the recording medium supporting belt 30 is changed.

TABLE 2

| paper temperature at | modulus of bending rigidity per unit width ($\times10^{-6}$ kgm$^2$) | | | | |
|---|---|---|---|---|---|
| depressing position | 0.3 | 0.8 | 3.6 | 9.4 | 26.8 |
| 95° C. | x | ○ | ○ | ○ | ○ |
| 115° C. | x | ○ | ○ | ○ | ○ |

In the table 2, symbol "○" shows such a condition that an exfoliation blister does not occur, and symbol "×" represents such a condition that an exfoliation blister occurs.

To carry out an evaluation of such n exfoliation blister phenomenon, as to the recording medium supporting belt 30, a polyimide film having a thickness of 20 $\mu$m to 100 $\mu$m was employed as the base layer thereof, and Teflon AF type 2400 (manufactured by Du Pont) having a thickness of 3 $\mu$m was used as the surface layer thereof. A pressure-applying position by the depressing/close-contacting roller 31 was set to each of places where a temperature of paper became 95° C. and 115° C., and a load was adjusted in such a manner that pressure at a nip portion becomes $5\times10^4$ Pa.

Also, in order to suppress deformation of the paper P just after pressure was applied by both the heating roller 6 and the pressure-applying roller 7 to a minimum deformation amount, in accordance with this embodiment, as to the polyimide film employed in the base layer of the recording medium supporting belt 30, this polyimide film owns the Young's modulus=$302\times10^6$ (kg/m$^2$) and also the layer thickness of 20 to 100 ($\mu$m); and as to Teflon AF type 2400 (manufactured by Du Pont) employed in the surface layer, this Teflon sheet owns the Young's modulus E=$40\times10^6$ (kg/m$^2$) and also the layer thickness of 3 ($\mu$m).

As apparent from the table 2, the occurrence of the exfoliation blister could be suppressed and the image having the better image quality could be obtained only under the following conditions. That is, a modulus of bending rigidity per unit width of such a belt which is employed as the recording medium supporting belt 30 was larger than, or equal to $0.8\times10^{-6}$ kgm$^2$.

It should also be noted that table 3 shows both an apparent Young's modulus and a modulus of bending rigidity per unit width in such a case that the thickness of the base layer is changed from 20 $\mu$m to 100 $\mu$m. It should further be noted that the Young's modulus in this table corresponds to a value measured at the ordinary temperature (25° C.).

TABLE 3

| | | | | | |
|---|---|---|---|---|---|
| thickness of base layer ($\mu$m) | 20 | 30 | 50 | 70 | 100 |
| apparent Young's modulus ($\times10^6$ kg/m$^2$) | 268 | 278 | 287 | 291 | 294 |
| bending rigidity per unit width ($\times10^6$ kg/m$^2$) | 0.3 | 0.8 | 3.6 | 9.4 | 26.8 |

Furthermore, in the above-described arrangement, while the pressure applied by the depressing/close-contacting roller 31 was changed, an image was outputted by using the toner B with respect to three sorts of the above-explained double-sided coated paper for printing. The evaluation as to the exfoliation blister was carried out.

Table 4 represents an evaluation result of exfoliation blisters in the case that the pressure applied by the depressing/close-contacting roller 31 is changed.

TABLE 4

| paper temperature at depressing | area pressure of depressing nip ($\times10^4$ Pa) | | | | | |
|---|---|---|---|---|---|---|
| position | 0.5 | 1 | 2 | 3 | 5 | 7 |
| 95° C. | x | x | ○ | ○ | ○ | ○ |
| 115° C. | x | x | ○ | ○ | ○ | ○ |

In the table 4, symbol "○" shows such a condition that an exfoliation blister does not occur, and symbol "x" represents such a condition that an exfoliation blister occurs.

To carry out an evaluation of such exfoliation blister phenomenon, as to the recording medium supporting belt 30, a polyimide film having a thickness of 70 $\mu$m was employed as the base layer thereof, and Teflon AF type 2400 (manufactured by Du Pont) having a thickness of 3 $\mu$m was used as the surface layer thereof. A pressure-applying position by the depressing/close-contacting roller 31 was set to each of places where a temperature of paper became 95° C. and 115° C., and load was adjusted in such a manner that pressure at a nip portion becomes $5\times10^4$ Pa.

As apparent from the above-described table 4, the occurrence of the exfoliation blister could be suppressed and thus, the image having the better image quality could be produced only in such a case that the load was adjusted in such a manner that pressure at the nip portion formed by depressing the counter member by the depressing/close-contacting roller 31 was higher than, or equal to $2\times10^4$ Pa.

From the above-described evaluation result as to the exfoliation blister phenomenon, such a fact could be confirmed. That is, the occurrence of such an exfoliation blister could be suppressed. The image having the better image quality could be formed by employing the following conditions. That is, while a recording medium supporting belt 30 is employed, which has the bending rigidity modulus per unit width larger than or equal to $0.8\times10^{-6}$ kgm$^2$, the recording medium supporting belt 30 supports the paper P which has been overlapped with the intermediate transfer belt 20 and to which heat and pressure have been applied, and then the paper P and the belt 20 are cooled by the cooling unit 15. The depressing/close-contacting roller 31 is arranged at the place of such a temperature range that the upper limit temperature of this paper P is equal to 125° C., and also such a temperature that the viscosity coefficient of the toner image sandwiched by the paper P and the intermediate transfer belt 20 is smaller than, or equal to $10^5$ Pa·S is defined as the lower limited temperature. Also, such a load is applied to the paper P under such a condition that the counter member is depressed by this depressing/close-contacting roller 31 to form the nip portion, and the pressure at this nip portion becomes higher than, or equal to $2\times10^4$ Pa.

Next, a fixing apparatus according to a second embodiment of the present invention will now be explained.

Figure 7:
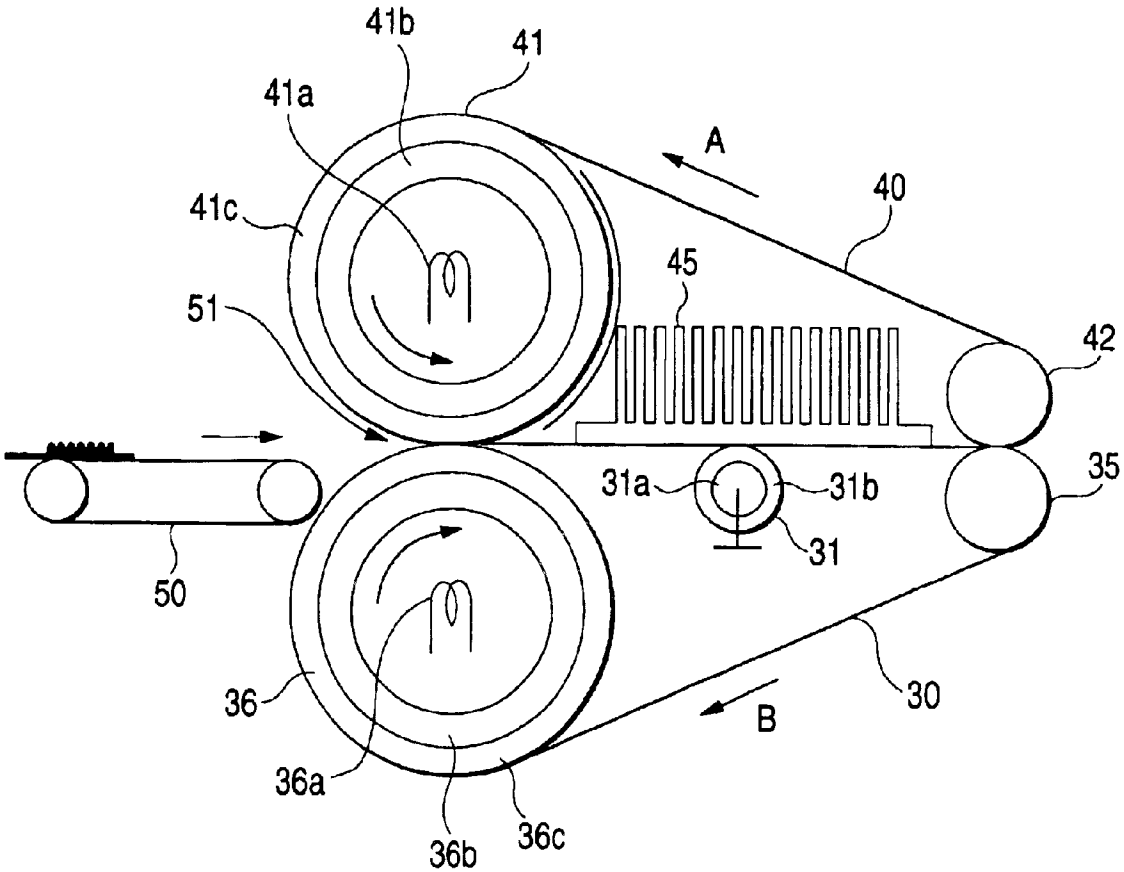
FIG. 7 is a diagram for indicating a schematic structure of a fixing apparatus according to a second embodiment of the present invention.

FIG. 7 is a schematic structural diagram for indicating the fixing apparatus according to the second embodiment of the present invention.

In FIG. 7, a belt-shaped fixing member 40 is transported in a circulation manner along an arrow-A direction, while the belt-shaped fixing member 40 is supported by a heating roller 41 and an exfoliating roller 42. Also, a belt-shaped recording medium supporting belt 30 is transported in a circulation manner along an arrow-B direction, while the belt-shaped recording medium supporting belt 30 is supported by a supporting roller 35 and a pressure-applying roller 36, and follows the fixing member 40. To a position where the heating roller 41 and the pressure-applying roller 36 are located opposite to each other by sandwiching the belt-shaped fixing member 40 and the belt-shaped recording medium supporting belt 30, a paper "P" is transported by a transporting belt 50. The paper P carries thereon a toner image formed in an image forming step such as an electrophtography system. While the paper P is sandwiched by the fixing member 40 and the recording medium supporting belt 30, heat and pressure are applied to the paper P by using the pressure-applying roller 36 and the heating roller 41. While the belt-shaped fixing member 40 is made in contact with the heating roller 41, the belt-shaped fixing member 40 is heated, so that a temperature of the belt-shaped fixing member 40 is increased. The temperature of the belt-shaped fixing member 40 reaches to a temperature substantially equal to the temperature of the heating roller 41 until the belt-shaped fixing member 41 reaches to a nip portion 51, which is formed by the heating roller 41 and the pressure-applying roller 36.

After the belt-shaped fixing member 41 has passed through the heating unit and the pressure-applying unit, the belt-shaped fixing member 41 is made in contact with a cooling member 41 equipped with a fin so as to cool, while maintaining either a flat-plane shape or a curved-plane shape. The cooling member 45 equipped with the fin is positioned on the side of the rear surface opposite to the side which is made in contact with the paper P. Thus, toners, which are made in close contact with this fixing member 40, are cooled, so that temperatures of these toners are lowered to temperatures nearly equal to the glass transition temperature.

In this embodiment, a length of the cooling member 45 which is made in contact to the fixing member 40 is 100 mm along the transport direction of the fixing member 40. While the fixing member 40 is made in contact to the cooling member 45, the recording paper P is cooled, so that water vapor pressure is lowered, and the depressing/close-contacting roller 31 is depressed against a counter member via both the recording member supporting belt 30 and the fixing member 40 so as to make the recording paper P in close contact to the fixing member 40, so that the toner image is reconstructed in a smooth manner at such a position where the toners are still under melting condition. Also, in this embodiment, a cooling member 45 is employed as this counter member. The cooling member 45 may improve the cooling effect by blowing wind to the fin so as to emphasize heat radiation from this fin.

In this case, as a materiel of the cooling member 45 equipped with the fin, such a material having a higher coefficient of thermal conductivity may be employed. In this embodiment, aluminum is employed as this material. The wind blowing operation is controlled in such a manner that the temperature of the belt-shaped fixing member 40 just after this belt-shaped fixing member 40 has passed through the cooling member 45 becomes nearly equal to 80° C. However, the present invention is not limited to this arrangement.

Also, a heat insulating material is provided on a peripheral surface of the heating roller 41 located opposite to the cooling member 45.

In this embodiment, as the belt-shaped fixing member 40, such a belt-shaped fixing member having a two-layer structure made of a base layer and a surface layer may be employed. As the base layer, a polyimide film having a thickness of 50 $\mu$m is employed, and DX 35-547 A/B silicone copolymer (manufactured by TOREI-DOW SILICONE) whose rubber hardness is 47 degrees and which has a thickness of 30 $\mu$m is employed as the surface layer. Among these materials, for example, a high heat-resisting sheet having a thickness of 10 to 100 $\mu$m may be used as the base layer, and also, a higher mold releasing resin may be used as the surface layer. It should be understood that the fixing member 40 may be tensioned with respect to the entire width of 320 mm under tension of approximately 59 N, but the present invention is not limited thereto.

As both the heating roller 41 and the pressure-applying roller 36, such a roller may be employed in which heat-resisting elastic layers 41*c* and 36*c* such as silicon rubber are used to cover metal rollers 41*b* and 36*b*. Also, heat sources 41*a* and 36*a* may be arranged inside the heating roller 41 and the pressure-applying roller 36. In this embodiment, silicon rubber having a hardness of 45 degrees is stacked in a thickness of 2 mm on a hollow roller made of aluminum to manufacture a roller whose outer diameter is 50 mm, which employed as the heating roller 41 and the pressure-applying roller 36. As the heat sources 41*a* and 36*a* employed inside this roller, a halogen lamp is employed. The temperature of the heating roller 41 is set in such a control manner that this temperature becomes higher than, or equal to the melting temperature of the toner. Also, load is changed to be controlled in order that a nip width made by two rollers is equal to 7 mm.

As the recording medium supporting belt 30, such a recording medium supporting belt having a two-layer structure made of a base layer and a surface layer may be employed. As to the base layer, a higher heat-resisting sheet having a thickness of approximately 20 to 300 $\mu$m may be employed. As this base layer, a polyimide film having a thickness of 70 $\mu$m is employed in this embodiment. As the surface layer, Teflon AF type 2400 (manufactured by Du Pont) having a thickness of 3 $\mu$m is used.

As to the depressing/close-contacting roller 31, such a roller may be employed in which a heat-resisting elastic layer such as silicon rubber is used to cover a metal roller. In this embodiment, silicon rubber having a hardness of 30 degrees is stacked in a thickness of 2 mm on a hollow roller made of aluminum to manufacture a roller whose outer diameter is 80 mm. Load of the depressing/close-contacting roller 31 is controlled in such a manner that pressure at a nip portion formed between the depressing/close-contacting roller 31 and the counter member become equal to 5'$10^4$ Pa.

With employment of the above-described arrangement, while a circulating transport speed of the belt-shaped fixing member 40 is selected to be 160 mm/s, and the above-described toner B is employed, images were outputted to three sorts of the following coated paper were employed, namely SD Lustro Gloss (manufactured by Warrent Inc.), OK TOPCOAT (manufactured by OJI SEISHI K.K.), and Consort Royal Silk (Donside Paper Inc.). Then, evaluations as to exfoliation blisters were carried out. At this time, pressure-applying positions by using the depressing/close-contacting roller 31 were selected to be two positions where temperatures of the paper P were 95° C. and 115° C. As a result, the occurrence of such an exfoliation blister could be suppressed, and thus, the image having the better image quality could be obtained.

In accordance with the image forming apparatus and the fixing apparatus of the present invention, even when the image is printed on the recording medium having the high air permeability such as the double-sided coated paper, the image having the high image quality can be formed without any exfoliation blister.

What is claimed is:

1. An image forming apparatus comprising;

an image carrying body for carrying a toner image thereon and moving in a predetermined travel direction;

a heating unit for heating the image carrying body to melt the toner image on the image carrying body;

a pressure unit for overlapping a recording medium with the image carrying body while the toner image melted by the heating unit is sandwiched between the recording medium and the image carrying body, the pressure unit for applying pressure at a pressure position to the recording medium and the image carrying body, which are overlapped with each other;

a recording medium supporting member moving in the predetermined travel direction from the pressure position to an exfoliation position while supporting the recording medium overlapped with the image carrying body; and a depressing/close-contacting unit for sandwiching and depressing the recording medium supporting member and the image carrying body in a middle position between the pressure position and the exfoliation position to closely contact the recording medium with the image carrying body, wherein after the pressure unit applies pressure, an image is formed on the recording medium by exfoliating the recording medium from the image carrying body at the exfoliation position, wherein the recording medium supporting member is an endless-shaped flat belt, and wherein a modulus of rigidity per unit width of the endless-shaped flat belt is not smaller than $0.8\times10^{-6}$ $kgm^2$.

2. An image forming apparatus comprising:

an image carrying body for carrying a toner image thereon and moving in a predetermined travel direction;

a heating unit for heating the image carrying body to melt the toner image on the image carrying body;

a pressure unit for overlapping a recording medium with the image carrying body while the toner image melted by the heating unit is sandwiched between the recording medium and the image carrying body, the pressure unit for applying pressure at a pressure position to the recording medium and the image carrying body, which are overlapped with each other;

a recording medium supporting member moving in the predetermined travel direction from the pressure position to an exfoliation position while supporting the recording medium overlapped with the image carrying body; and a depressing/close-contacting unit for sandwiching and depressing the recording medium supporting member and the image carrying body in a middle position between the pressure position and the exfoliation position to closely contact the recording medium with the image carrying body, wherein after the pressure unit applies pressure, an image is formed on the recording medium by exfoliating the recording medium from the image carrying body at the exfoliation position, and wherein the depressing/close-contacting unit sandwiches and depresses the recording medium supporting member and the image carrying body at a place where:

the recording medium has a temperature not higher than 125° C.; and the toner image sandwiched between the recording medium and the image carrying body has a viscosity coefficient not larger than $10^5$ Pa·s.

3. An image forming apparatus comprising:

an image carrying body for carrying a toner image thereon and moving in a predetermined travel direction;

a heating unit for heating the image carrying body to melt the toner image on the image carrying body;

a pressure unit for overlapping a recording medium with the image carrying body while the toner image melted by the heating unit is sandwiched between the recording medium and the image carrying body, the pressure unit for applying pressure at a pressure position to the recording medium and the image carrying body, which are overlapped with each other;

a recording medium supporting member moving in the predetermined travel direction from the pressure position to an exfoliation position while supporting the recording medium overlapped with the image carrying body; and a depressing/close-contacting unit for sandwiching and depressing the recording medium supporting member and the image carrying body in a middle position between the pressure position and the exfoliation position to closely contact the recording medium with the image carrying body, wherein after the pressure unit applies pressure, an image is formed on the recording medium by exfoliating the recording medium from the image carrying body at the exfoliation position, and wherein the depressing/close-contacting unit includes at least one depressing portion having:

a roll-shape depressing member; and a facing member facing the depressing member; and wherein the depressing member sandwiches and depresses the recording medium supporting member and the image carrying body so that pressure applied to the recording medium supporting member and the image carrying body is not lower than $2\times10^4$ Pa.

4. A fixing apparatus comprising:

a fixing belt moving in a predetermined direction;

a heating/pressuring unit having a pair of rollers sandwiching the fixing belt and being opposed to each other to form a nip portion, the heating/pressuring unit for overlapping a recording medium with the fixing belt while sandwiching a toner image between the recording medium and the fixing belt by the nip portion and for heating and applying pressure to the recording medium and the fixing belt at a heating position;

a recording medium supporting member moving in the predetermined direction from the pressure position to an exfoliation position while supporting the recording medium overlapped with the fixing belt; and a depressing/close-contacting unit for sandwiching and depressing the recording medium supporting member and the fixing belt in a middle position between the pressure position and the exfoliation position to closely contact the recording medium with the fixing belt, wherein after the heating/pressuring unit heats and applies pressure, an image is formed on the recording medium by exfoliating the recording medium on which the toner image is fixed from the fixing belt at the exfoliation position, wherein the recording medium supporting member is an endless-shaped flat belt; and wherein a modulus of rigidity per unit width of the endless-shaped flat belt is not smaller than $0.8\times10^{-6}$ $kgm^2$.

5. A fixing apparatus comprising:

a fixing belt moving in a predetermined direction;

a heating/pressuring unit having a pair of rollers sandwiching the fixing belt and being opposed to each other to form a nip portion, the heating/pressuring unit for overlapping a recording medium with the fixing belt while sandwiching a toner image between the recording medium and the fixing belt by the nip portion and for heating and applying pressure to the recording medium and the fixing belt at a heating position;

a recording medium supporting member moving in the predetermined direction from the pressure position to an exfoliation position while supporting the recording medium overlapped with the fixing belt; and a depressing/close-contacting unit for sandwiching and depressing the recording medium supporting member and the fixing belt in a middle position between the pressure position and the exfoliation position to closely contact the recording medium with the fixing belt, wherein after the heating/pressuring unit heats and applies pressure, an image is formed on the recording medium by exfoliating the recording medium on which the toner image is fixed from the fixing belt at the exfoliation position, wherein the depressing/close-contacting unit sandwiches and depresses the recording medium supporting member and the fixing belt at a place where:

the recording medium has a temperature not higher than 125° C.; and the toner image sandwiched between the recording medium and the fixing belt has a viscosity coefficient not larger than $10^5$ Pa·s.

6. A fixing apparatus comprising:

a fixing belt moving in a predetermined direction;

a heating/pressuring unit having a pair of rollers sandwiching the fixing belt and being opposed to each other to form a nip portion, the heating/pressuring unit for overlapping a recording medium with the fixing belt while sandwiching a toner image between the recording medium and the fixing belt by the nip portion and for heating and applying pressure to the recording medium and the fixing belt at a heating position;

a recording medium supporting member moving in the predetermined direction from the pressure position to an exfoliation position while supporting the recording medium overlapped with the fixing belt; and a depressing/close-contacting unit for sandwiching and depressing the recording medium supporting member and the fixing belt in a middle position between the pressure position and the exfoliation position to closely contact the recording medium with the fixing belt, wherein after the heating/pressuring unit heats and applies pressure, an image is formed on the recording medium by exfoliating the recording medium on which the toner image is fixed from the fixing belt at the exfoliation position, wherein the depressing/close-contacting unit includes at least one depressing portion having:

a roll-shape depressing member; and a facing member facing the depressing member; and wherein the depressing member sandwiches and depresses the recording medium supporting member and the fixing belt so that pressure applied to the recording medium supporting member and the fixing belt is not lower than $2\times10^4$ Pa.

* * * * *